US005630552A

United States Patent [19]

Anfindsen et al.

[11] Patent Number: 5,630,552

[45] Date of Patent: May 20, 1997

[54] PAINT DOSAGE DEVICE FOR PROGRAM CONTROLLED SPRAY PAINTING SYSTEM

[75] Inventors: Ole A. Anfindsen, Sandnes; Alf Sunde, Byrne, both of Norway

[73] Assignee: ABB Flexible Automation AS, Bryne, Norway

[21] Appl. No.: 335,817

[22] PCT Filed: May 15, 1992

[86] PCT No.: PCT/NO92/00093

§ 371 Date: Nov. 15, 1994

§ 102(e) Date: Nov. 15, 1994

[87] PCT Pub. No.: WO93/23173

PCT Pub. Date: Nov. 25, 1993

[51] Int. Cl.[6] ..... B05B 5/025

[52] U.S. Cl. ..... 239/708; 239/112; 251/240

[58] Field of Search ..... 239/690, 691, 239/708, 68, 69, 3, 112; 137/240, 567; 118/626, 629; 427/421, 475

[56] References Cited

U.S. PATENT DOCUMENTS

| | | | |
|---|---|---|---|
| 4,249,560 | 2/1981 | Raque et al. | 137/240 |
| 4,501,288 | 2/1985 | Field | 137/240 |
| 4,792,092 | 12/1988 | Elberson et al. | 239/691 X |
| 4,884,752 | 12/1989 | Plummer | 239/691 |
| 4,932,589 | 6/1990 | Diana | 239/691 X |
| 5,094,389 | 3/1992 | Giroux et al. | 239/690 |
| 5,096,126 | 3/1992 | Giroux et al. | 239/690 |
| 5,102,045 | 4/1992 | Diana | 239/691 X |
| 5,106,024 | 4/1992 | Frene et al. | 239/690 |
| 5,255,856 | 10/1993 | Ishibashi et al. | 239/691 |

FOREIGN PATENT DOCUMENTS

| | | | |
|---|---|---|---|
| 292778 | 11/1988 | European Pat. Off. | 239/691 |
| 0467626A1 | 1/1992 | European Pat. Off. . | |
| 2249498 | 5/1992 | United Kingdom . | |

*Primary Examiner*—Lesley D. Morris
*Attorney, Agent, or Firm*—Bacon & Thomas

[57] ABSTRACT

A paint dosage device is particularly adapted to be mounted in close proximity to a spray gun (P) in a program controlled spray painting installation for dosed paint supply to the spray gun. The device includes at least two dosage cylinders (SA,SB), each having a regulating piston (PA,PB) connected to a piston departure position and displacement velocity regulator (RA,MA:RB,MB) for setting the paint filling amount of the associated cylinder by controlled adjustment of the departure position of the regulating piston in the cylinder, and for setting the dosage rate of the cylinder when supplying paint to the spray gun, by program controlling the displacement velocity of the regulating piston in the cylinder. A valve assembly (V1,V2,V3,V4) is arranged for connecting the cylinders (SA,SB) alternately to the spray gun (P) and putting the cylinder disconnected from the gun in connection with means for cleansing and paint filling apparatus. This paint dosage device is particularly suitable for application in the case the spray gun is provided with high tension electrode (E) for electrostatically charged atomizing of supplied electrically conductive paint. Each regulating piston (PA,PB) of the cylinders is then connected with the a piston departure position and displacement velocity regulator by means of an electrically insulating motion-transferring connection (IA,IB) and each valve (V1,V2,V3, V4) of the valve assembly is made electrically insulating.

9 Claims, 3 Drawing Sheets

PAINT DOSAGE DEVICE FOR PROGRAM CONTROLLED SPRAY PAINTING SYSTEM

BACKGROUND OF THE INVENTION

The present invention is related to a paint dosage device adapted for mounting in close proximity to a spray gun in a program controlled spray painting installation, for dosed paint supply to the spray gun, in particular in the case the spray gun is provided with high tension electrode for electrical atomizing of the supplied electrically conductive paint.

As dosage means for paint supply to spray guns, cogwheel pumps, dosage by pressurized air or the like are used. Such means often have a narrow regulation range, are highly viscosity dependent and cumbersome to clean when shifting paint color. Furthermore the mounting of such device in close proximity to the spray gun has been difficult, and long connection hoses, possibly subjected to vibration, make accurate and rapid adjustable paint dosage, which at all times is adapted to the program controlled painting process in operation, difficult to achieve. With use of spray gun with high tension atomizing, insulation of the paint dosage of the gun from the remaining part of the painting istallation has been found difficult.

SUMMARY OF THE INVENTION

It is then an object of the present invention to provide a paint dosage device of the type indicated above, and by which the indicated disadvantages of the prior art dosage means are overcome.

The unique inventive feature of this paint dosage device according to the invention is that it comprises at least two dosage cylinders, each having a regulating piston connected to regulation means for setting the paint filling amount of the associated cylinder by controlled adjustment of the departure position of the regulating piston in the cylinder, as well as the dosage rate of the paint supply to the spray gun by program controlling the displacement velocity of the regulating piston in the cylinder, a valve assembly being arranged for connecting the cylinders alternately to the spray gun and putting the cylinder disconnected from the gun in connection with means for cleansing and paint filling.

Such a device is particularly suitable to the purpose in the case the spray gun is provided with high tension electrode for electrostatically charged atomizing of the supplied electrically conductive paint, and the regulating pistons of the cylinders are then according to the invention connected with the regulation means by means of an electrically insulating motion-transferring connection.

The valve assembly comprises preferably four valves in a rectangularly shaped arrangement wherein the valves which are associated with the cylinder outlets and the paint inlet of the spray gun are arranged along the same side while the two sides adjacent to this one side house the valves that connect between the cylinder outlet and the sump of spent cleansing liquid from the cleansing of the cylinders. This arrangement is referred to in the art as a bridge connection. In case the spray gun is furnished with high tension electrode and electrically conductive paint is used, each valve in the valve assembly is made electrically insulating by manufacturing both the stationary valve housing and the moveable valve member in insulating material.

Further, each regulating piston comprises internal flow channels for cleansing the inside of the dosage cylinder by supplying cleansing liquid to and retracting such liquid from the contact surface of the piston against the cylinder wall.

These internal flow channels then preferably lead into circumferential grooves in said contact surface of the regulating piston.

BRIEF DESCRIPTION OF THE DRAWINGS

The invention will now be further explained by means of an exemplary embodiment and with reference to the accompanying drawings, on which.

DETAILED DESCRIPTION OF THE PREFERRED EMBODIMENTS

Figure 1:
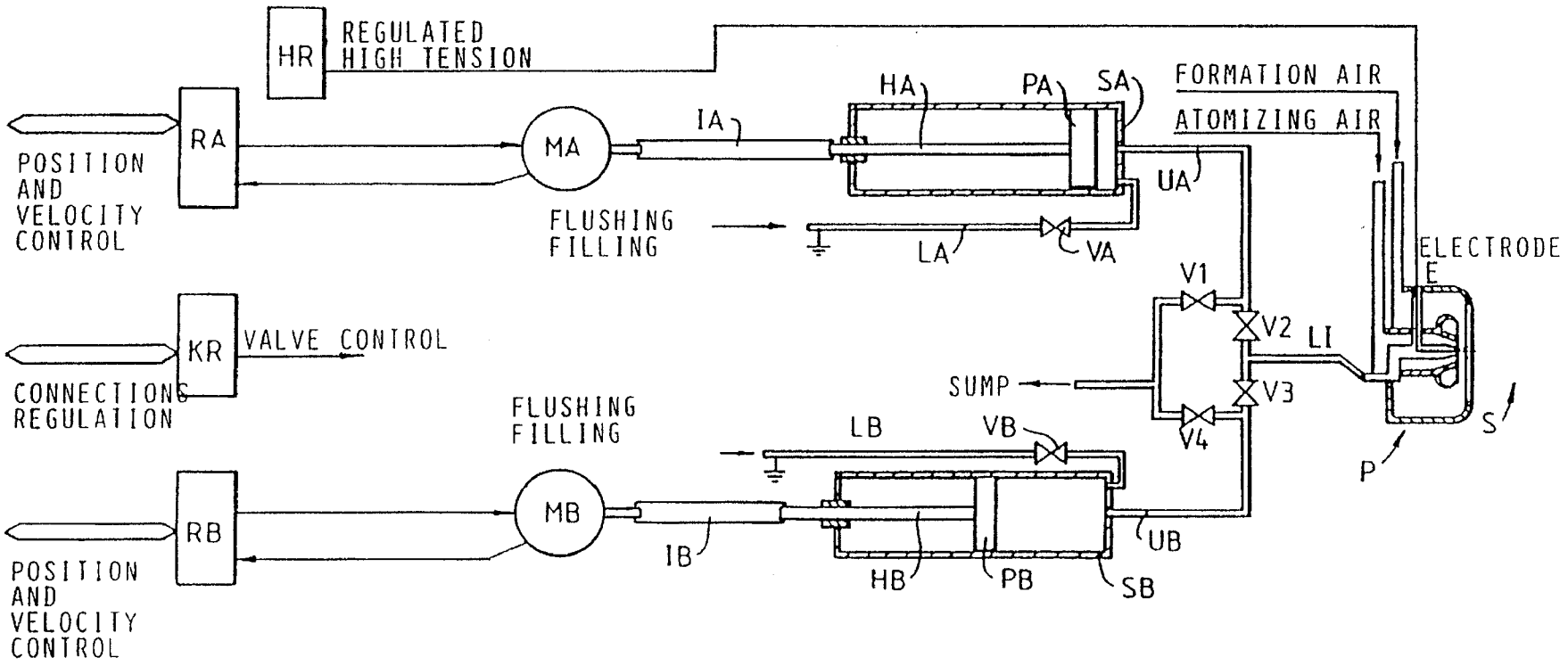
FIG. 1 shows schematically a robot controlled painting installation having a paint dosage device according to the invention for paint supply to a spray gun provided with high tension electrode.

The spray painting installation shown in FIG. 1 for the application of electrostatically atomized paint comprises dosage cylinders SA, SB, each having a regulating piston PA or PB, respectively, regulation means MA, RA or MB, RB for controlling the position and displacement velocity of the regulating pistons in the dosage cylinders, as well as a controlled valve assembly V1, V2, V3, V4 having connection regulating means KR for connecting the cylinders alternately to the spray gun P and putting the cylinder disconnected from the gun in connection with means for cleansing and refilling of paint. The spray gun P is in the embodiment shown also provided with a high tension electrode E for eletrostatically charging the supplied electrically conductive paint, which is atomized by means of supplied atomizing air to the gun, the cloud formed by atomized paint particles being suitable shaped for the purpose by beam formation air, which also is supplied to the spray gun. The electrode E of the gun is connected with a source HR of regulated high tension in accordance with security rules.

The dosage regulating means RA, MA or RB, MB, respectively, associated with each dosage cylinder is operatively adapted for setting the paint filling amount of the cylinder in question by program controlled adjustment of the departure position of the regulating piston in the cylinder, and also the dosage rate of the paint supplied to the spray gun by program controlling the displacement velocity of the regulating piston in the cylinder. The paint being conductive and in contact with the high tension electrode E of the spray gun in the present case, the regulation piston PA, PB of each cylinder is isolated from its associated driving motor MA, MB by means of an electrically insulating motion-transferring connection in the form of a shaft member IA, IB of insulating material.

The valve assembly for connecting the cylinders alternately to the spray gun, comprises in the present case four valves V1, V2, V3, V4 in a rectangularly shaped arrangement referred to in the art as a bridge connection, in which the outlet conduits UA and UB of the two dosage cylinders are connected with respective valves V1,V2 and V3,V4, in which the paint inlet L1 is connected between valves V2 and V3, and in which a sump for spent cleansing liquid from the cleansing of the cylinders is connected between valves V1 and V4. When the cylinder SA is to be connected to the spray gun through the outlet conduit UA, connection regulation means KR makes provision for the closure of the valves V1 and V3, whereas the valve V2 is open to put the outlet conduit UA in connection with the paint inlet LI of the spray gun, and the valve V4 is open in order to bring the outlet conduit UB of the other cylinder SB in connection with said liquid sump. In this operational phase the cylinder SB is flushed clean by means of supplied cleansing liquid through its inlet conduit LB with inserted valve VB, which then is kept open by means of valve control from the connection regulation means KR. When the cleansing of the cylinder SB is completed, its regulating piston PB is set to a program determined departure position in the cylinder for defining the paint filling amount of the cylinder, when refilling the cylinder through the inlet conduit LB, in order to prepare the cylinder SB for dosed paint supply to the spray gun P when the cylinder SA has finished its running dosage phase and the valves in the valve assembly are correspondingly adjusted for the switching of the operational functioning of the cylinders by means of valve control performed by the connection regulation means KR, in order to subject the cylinder SA to flushing with the cleansing liquid through the inlet conduit LA and open inlet valve VA and subsequent regulated paint refilling, while the cylinder SB is operative with its program controlled dosage function.

Figure 2:
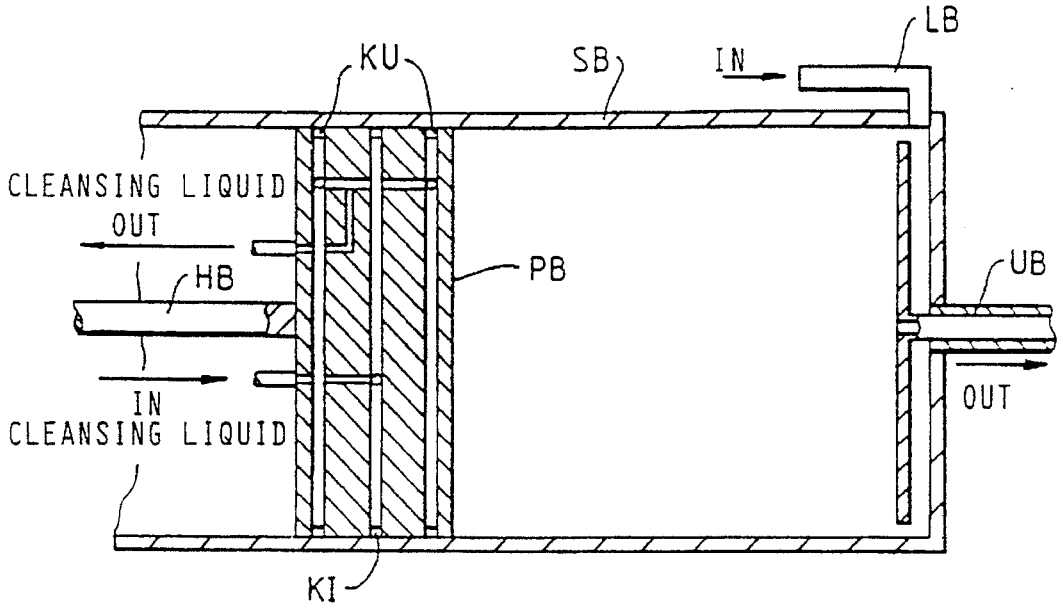
FIG. 2 shows an enlarged section through a dosage cylinder provided with a regulating piston which is furnished with internal cleansing channels.

In addition to the cleansing of each cylinder by supplying cleansing liquid through the inlet conduit LB to the peripheral portion of the cylinder and discharge of spent cleansing liquid through the outlet conduit UB, as shown in more detail for the cylinder SB in FIG. 2, the regulating piston PB of the cylinder is also provided with internal flow channels KI and KU for cleansing of the inside of the dosage cylinder by supplying cleansing liquid to and retracting such liquid from the contact surface of the piston against the cylinder wall. These internal flow channels KI, KU lead preferably into circumferential grooves in said contact surface of the regulating piston.

By insulating an accurately measured amount of paint in dosage cylinders SA, SB in close proximity to the spray gun, the passage of paint hoses on high tension through the conductive paint into the remaining part of the spray painting installation, is avoided. The paint filling amount of each cylinder is defined by the regulation means RA, RB and is adjusted by position setting of the regulating pistons PA, PB in the cylinders. The dosage rate during the spray painting is defined by accurate velocity control of the motion of the regulating pistons, coordinated with the movements of the spray gun.

To achieve continuity of the spray painting, two cylinders SA and SB are used alternately for the spraying of atomized paint or clean flushing and refilling, respectively. The cylinder that performs the dosage of paint to the spray gun is insulated from earth and connected to the high tension means, whereas the cylinder that is flushed clean and subsequently refilled is insulated from the high tension means and maintained on earth potential.

Said cleansing of the cylinder wall by means of the internal channels for cleansing liquid in the regulating pistons PA, PB in the cylinders makes the change of paint color in the cylinders easier. Through inlet openings in the end wall of the cylinder cleansing liquid is flushed under pressure peripherally into the cylinder space to be cleansed, whereupon the supplied liquid together with remaining paint is drained out to the earlier mentioned slump of waste liquid, through the outlet opening in the center of the end wall and open valve in the valve assembly.

The switching of the high tension means on and off is controlled together with the connection regulation of the valves. Also, the high tension cannot be applied before the gun connected cylinder is disconnected from the paint filling source by means of the valve VA, VB on the inlet side.

Figure 3:
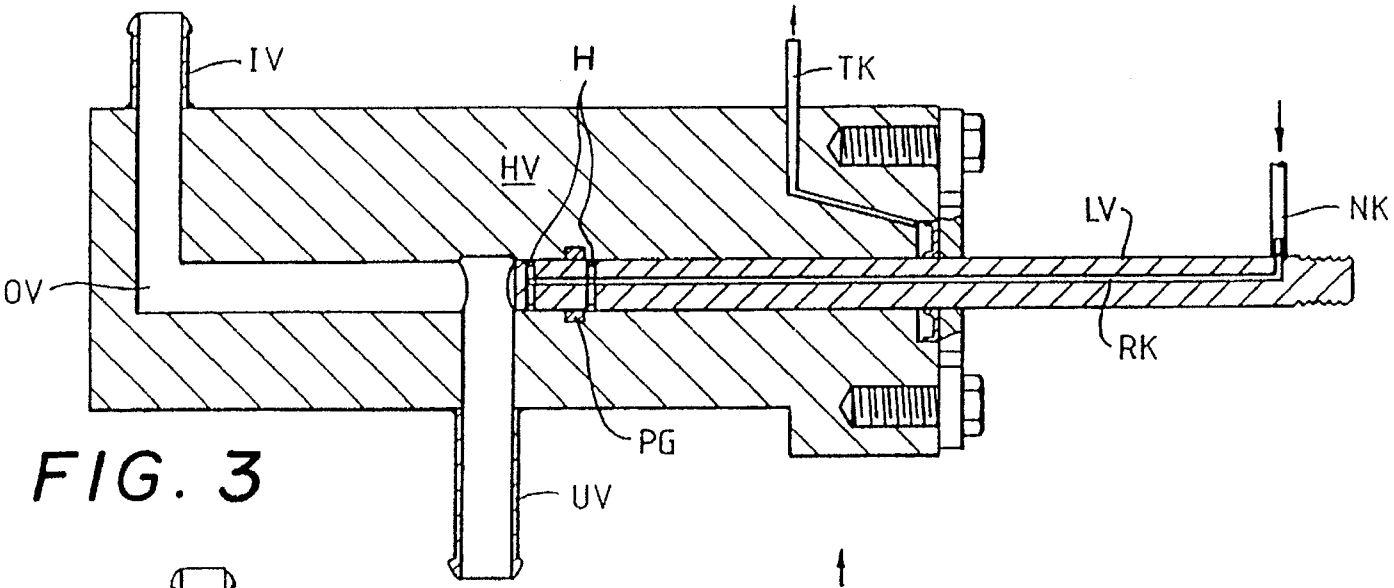
FIG. 3 shows in open position a section through an insulating valve in the valve assembly for securing paint supply to the spray gun alternately from the two dosage cylinders.

The valve assembly for controlled switching of the paint dosage connection between the cylinders and the spray gun comprises four mutually identical valves V1, V2, V3, V4, one of which is shown in open position in FIG. 3. These valves are made to be electrically insulating by manufacturing both the stationary valve housing HV and the moveable valve member LV from insulating material. The valve housing has an internal bore OV, and the valve member LV is closely fitted as a plunger in this bore, both the inlet and the outlet of the valve leading into said bore. In this manner the valve member is disposed for alternatively closing and opening inlet IV and/or outlet UV. Further, the bore OV of the valve housing is furnished with a sealing gasket PG positioned in a surface of the bore that rests against the plunger formed valve member, and an internal supply channel RK for an electrically non-conductive lubrication and cleansing agent leads longitudinally through the interior of the valve member and is provided with outlet openings H in the contact surface of the valve member against the bore wall in the valve housing. Also, the bore is connected with a return channel TK for lubrication and cleansing agent present in the bore between gasket PG and return channel TK.

Figure 4:
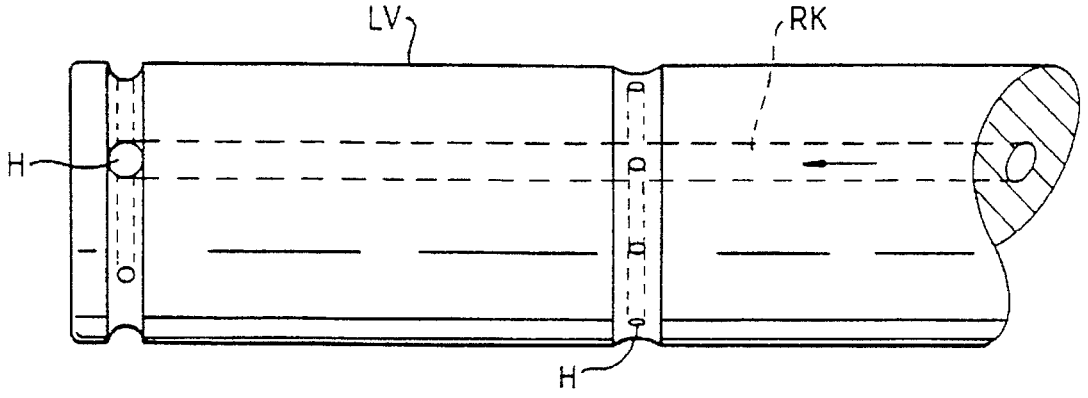
FIG. 4 shows enlarged the extreme end of the plunger shaped valve member in the valve shown in FIG. 3.

The extreme end of the valve member LV with the internal supply channel RK and the outlet opening H of the channel leading into circumferential grooves at said extreme end of said member, is shown enlarged and more clearly in FIG. 4.

A bias (not shown) between the valve housing HV and the valve member LV necessitates use of a certain displacement force and a non-conducting liquid as lubrication agent, and even as cleansing substance for removal of residues of conductive paint from the walls of the bore OV when closing the valve.

Figure 5:
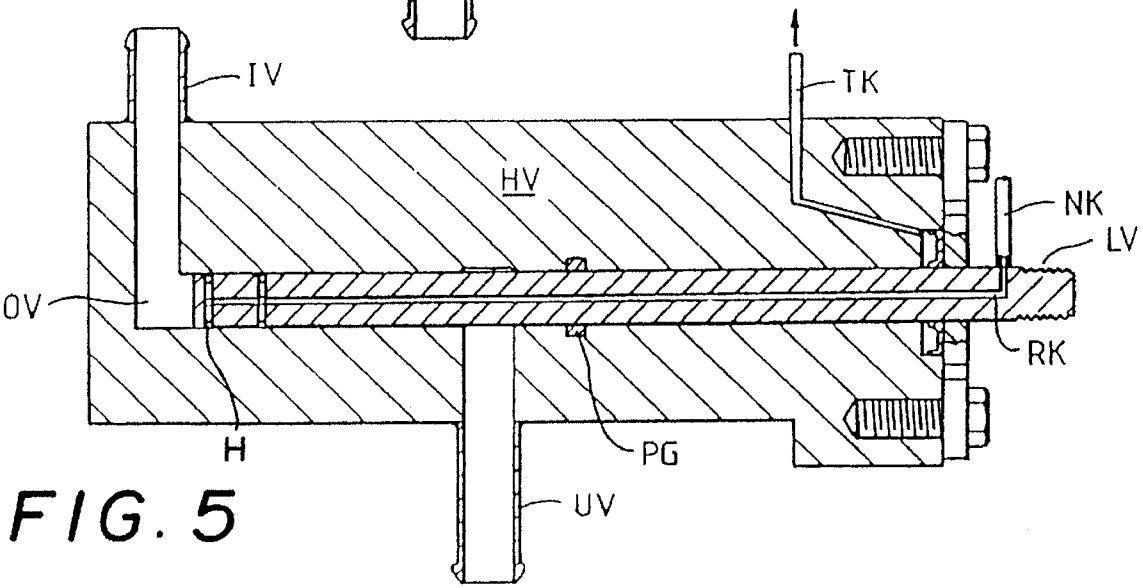
FIG. 5 shows the valve in FIG. 3 in closed position.

The valve shown in FIG. 3 is further shown in closed position in FIG. 5. From this figure it appears that the outlet UV of the valve here is disconnected from the valve inlet IV by means of the plunger shaped valve member LV, which in closed valve position is pushed to the maximum degree into the bore OV. An essential portion of the supplied lubrication and cleansing liquid will by shifting the valve member to the closed position be retained by the gasket PG and tapped out from the bore through the return outlet TK.

One or more extra dosage cylinders of the type indicated above may in a certain embodiment of the paint dosage device according to the invention be disposed for dosage of curing agent or a further paint component together with paint from the one or the other of the dosage cylinders described above. The two components which then are to be dosed in combination to the spray gun, are preferably thoroughly blended in an eddying mixing operator.

The paint dosage device according to the invention contributes to a great extent to the achievement of a simple and functionally correct paint dosage operation having short reaction time in a program controlled spray painting installation, particularly in the case wherein the spray gun is provided with a high tension electrode for electrostatically charged atomizing of the supplied electrically conductive paint.

We claim:

1. A spray painting apparatus adapted for dosed supply of electrically conductive paint to a spray gun, the spray gun being provided with a high tension electrode for electrostatically charged atomizing of electrically conductive paint supplied thereto:

at least two dosage cylinders, each having an inlet conduit through which paint and cleansing liquid are alternatively supplied, and an outlet conduit for alternative delivery of said paint and cleansing liquid to, respectively, the spray gun and a sump for spent cleansing liquid;

at least one inlet valve disposed in each of said inlet conduits; and a valve assembly including a plurality of valves arranged for connecting said outlet conduits alternatively to the spray gun and the sump for spent cleansing liquid, wherein each valve of the valve assembly as well as each inlet valve includes:

a valve housing and a movable valve member, the valve housing having an internal bore in communication with a valve inlet and a valve outlet connected by a portion of said bore, wherein the movable valve member is a plunger closely fitted in said bore and disposed for alternatively closing and opening said valve inlet and valve outlet, and the bore is furnished with a sealing gasket resting against the movable valve member and positioned in a surface of the bore outside of said portion of the bore connecting the valve inlet and valve outlet.

2. An apparatus as claimed in claim 1, wherein said plunger is provided with an internal supply channel for an electrically non-conductive lubrication and cleansing agent and includes outlet openings into a contact surface of the plunger against the bore of the valve housing, and said bore further communicates with a return channel for receiving any lubrication and cleansing agent present between the sealing gasket and the return channel.

3. An apparatus as claimed in claim 1, wherein the valve assembly comprises two pairs of valves arranged such that said outlet conduits of said at least two dosage cylinders are connected with respective pairs of said plurality of valves, with a first valve in each pair being connected to a paint inlet of the spray gun and a second valve in each pair being connected to said sump for receiving spent cleansing liquid from the cleansing of the at least two dosage cylinders.

4. An apparatus as claimed in claim 1, wherein both said valve housing and said movable valve member of each valve are manufactured from insulating material.

5. An apparatus as claimed in claim 1, wherein said at least two dosage cylinders each has a regulating piston connected to regulation means adapted for setting a paint filling amount of the associated one of said at least two dosage cylinders by controlled adjustment of a departure position of the regulating piston in said one of the at least two dosage cylinders, and wherein said regulation means is further adapted to set a dosage rate of paint supplied to the spray gun, by program controlling a displacement velocity of the regulating piston in the cylinder.

6. An apparatus as claimed in claim 5, wherein each regulating piston of the at least two dosage cylinders is connected with said regulation means by means of an electrically insulating motion-transferring link.

7. An apparatus as claimed in claim 5, wherein each regulating piston comprises internal flow channels leading into circumferential grooves in a contact surface of the regulating piston against an inside wall of a respective one of the at least two dosage cylinders for cleansing thereof by supplying cleansing liquid through one of said internal flow channels, and wherein spent cleansing liquid from the cleansing of said inside wall is retracted from said contact surface through another of said internal flow channels.

8. A valve for a spray painting apparatus adapted for dosed supply of electrically conductive paint to a spray gun, the spray gun being provided with a high tension electrode for electrostatically charged atomizing of electrically conductive paint supplied thereto, comprising a valve housing and a movable valve member, the valve housing having an internal bore in communication with a valve inlet and a valve outlet connected by a portion of said bore, wherein the movable valve member is a plunger closely fitted in said bore and disposed for alternatively closing and opening said valve inlet and valve outlet, and the bore is furnished with a sealing gasket resting against the movable valve member and positioned in a surface of the bore outside of said portion of the bore connecting the valve inlet and valve outlet.

9. A valve as claimed in claim 8, wherein the movable valve member is provided with an internal supply channel for an electrically non-conductive lubrication and cleansing agent and includes outlet openings into a contact surface of the plunger against the bore of the valve housing, and said bore further communicates with a return channel for receiving any lubrication and cleansing agent present between the sealing gasket and the return channel.

* * * * *